United States Patent [19]

Romer

[11] 4,427,346

[45] Jan. 24, 1984

[54] MOTOR-DRIVEN RECIPROCATING PISTON COMPRESSOR, PARTICULARLY FOR HERMETICALLY ENCAPSULATED SMALL REFRIGERATORS

[75] Inventor: Bendt W. Romer, Hjortevej, Denmark

[73] Assignee: Danfoss A/S, Nordborg, Denmark

[21] Appl. No.: 356,838

[22] Filed: Mar. 10, 1982

[30] Foreign Application Priority Data

Mar. 21, 1981 [DE] Fed. Rep. of Germany ..... 3111253

[51] Int. Cl.[3] ..... F04B 49/02

[52] U.S. Cl. ..... 417/292; 417/299; 417/902; 62/196.3

[58] Field of Search ..... 417/292, 299, 902; 62/196 C

[56] References Cited

U.S. PATENT DOCUMENTS

| | | | |
|---|---|---|---|
| 1,607,657 | 11/1926 | Whitehead | 417/292 X |
| 2,520,674 | 8/1950 | Buschmann | 62/196 C |
| 3,606,588 | 9/1971 | Romerhaus | 417/292 |
| 3,996,761 | 12/1976 | Richardson | 417/292 X |
| 4,025,239 | 5/1977 | Richardson et al. | 417/292 |
| 4,026,122 | 5/1977 | Kuhn et al. | 417/299 X |

*Primary Examiner*—Richard F. Gluck

*Attorney, Agent, or Firm*—Wayne B. Easton

[57] ABSTRACT

The invention relates to a motor driven reciprocating piston compressor of the type utilized for encapsulated small refrigerators. Valving for the valve plate between the piston and cylinder chamber provides automatic unloading when the gas in the cylinder chamber falls below a predetermined temperature in the 80 to 100 degree centigrade range to prevent pressure build ups in the cylinder chamber during idle periods which cause undesired high starting torques.

1 Claim, 2 Drawing Figures

Figure 1:
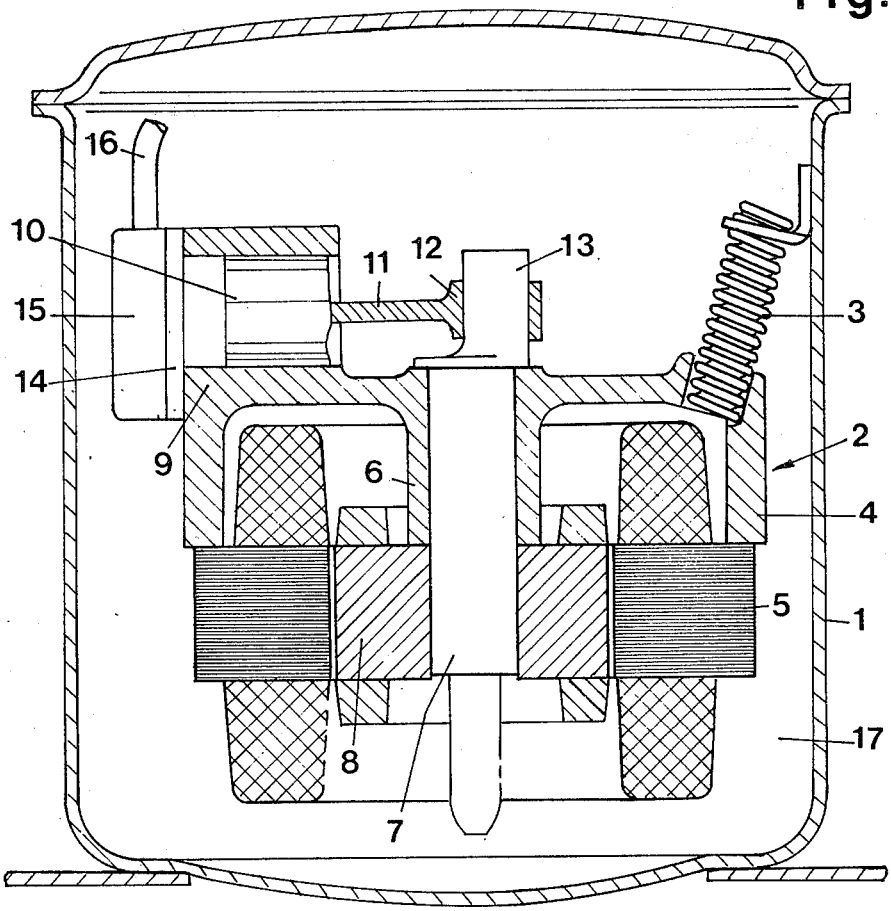

MOTOR-DRIVEN RECIPROCATING PISTON COMPRESSOR, PARTICULARLY FOR HERMETICALLY ENCAPSULATED SMALL REFRIGERATORS

The invention relates to a motor-driven reciprocating piston compressor, particularly for hermetically encapsulated small refrigerators, comprising starting relief by a throttling connecting passage leading to the suction side.

The starting of motor-driven reciprocating piston compressors is often made difficult by the fact that during the standstill period of the compressor a pressure builds up in the cylinder chamber that is above the suction pressure. In a refrigerator, a leaking pressure valve can for example enable refrigerant vapour to penetrate into the cylinder chamber and increase the pressure therein to above the suction pressure. This necessitates a high starting torque for which the motor is not designed.

In a known reciprocating piston compressor of the aforementioned kind (DE-PS No. 11 22 209), it is already known to provide the suction valve plate with a fine bore or to provide a fine slit in the seat of the suction valve to facilitate starting particularly in the case of encapsulated small refrigerators with capillary tube drive and thereby enable the motor to be smaller and cheaper. In this way the excess pressure occurring during standstill can be relieved. However, this feature makes the volumetric efficiency worse. Another possibility is to provide one or more lubricating grooves extending from the end face of the piston along the piston surface and terminating at a point which, in the upper dead centre position of the piston, is somewhat within the cylinder. These lubricating grooves only serve as relief passages when the piston is in the lower dead centre position.

The invention is based on the problem of providing a motor-driven reciprocating piston compressor of the aforementioned kind wherein starting relief is possible in every piston position and the volumetric efficiency is only slightly affected, if at all.

This problem is solved according to the invention in that the connecting passage extends from a chamber on the pressure side and can be closed by a stop valve which is controlled in response to temperature and of which the temperature responsive setting element is disposed in a chamber on the pressure side and closes the stop valve when the pressurised gas temperature exceeds a predetermined value.

In this construction, the connecting passage extends from a chamber on the pressure side and not from the cylinder chamber. When the chamber on the pressure side is relieved, no excess pressure can build up in the cylinder chamber either. The function of the connecting passage is independent of the position of the piston. Since the stop valve is controlled in response to the temperature of the compressed gas, the connecting passage opens on standstill of the compressor and corresponding cooling of the gas so that the desired relief is obtained. However, when the compressor has run up to speed, the pressure on the pressure side builds up because the connecting passage is designed as a throttling passage. Consequently, the temperature of the compressed gas will also rise until after a short time the stop valve closes. The volumetric efficiency is therefore fully maintained except for slight losses during the starting phase.

In a motor-driven reciprocating piston compressor in which the cylinder is covered at the end by a valve plate with an interposed sealing plate, the valve plate forming together with a cylinder cover at least one cylinder chamber on the pressure side, it is advisable for the connecting passage to extend from the cylinder cover chamber on the pressure side and for the valve with its setting element to be likewise disposed in this cylinder cover chamber. In this way, no additional space is required for making the additional provisions. Since the temperature-responsive setting element is accommodated in the cylinder cover chamber, it is heated directly by the conveyed pressurised gas.

In a particularly simple embodiment, the temperature-responsive setting element is a bimetal element. This provides a very robust setting element which guarantees a long life even in connection with the compressor of a refrigerator.

In a preferred embodiment, a bimetal strip extends parallel to the valve plate through the cylinder cover chamber, is secured to the cylinder cover at one end and carries the stop valve closing member at the other end, the connecting passage starting with a bore and the bore forming the stop valve seat on the inlet side. A comparatively long length is available for the bimetal strip so that comparatively low temperature differences will suffice to open or close the stop valve. In addition, the construction is simple because the closing member is connected directly to the bimetal strip and the seat of the stop valve is formed directly at the inlet to the bore.

It is advisable for the bore of the connecting passage to pass through the valve plate. In comparison with a bore in the dividing wall of the cylinder cover, this has the advantage that this bore can be very simply produced.

In a reciprocating piston compressor arranged in a capsule at suction pressure, there is the additional possibility for the sealing plate to have a cut-out extending from the end of the connecting passage bore in the valve plate to the periphery of the sealing plate. This also contributes to a simple and space-saving construction.

It is favourable for the stop valve to be designed to close at 80° to 100° C. This temperature ensures that it will already open upon only partial cooling after a short standstill period.

Figure 2:
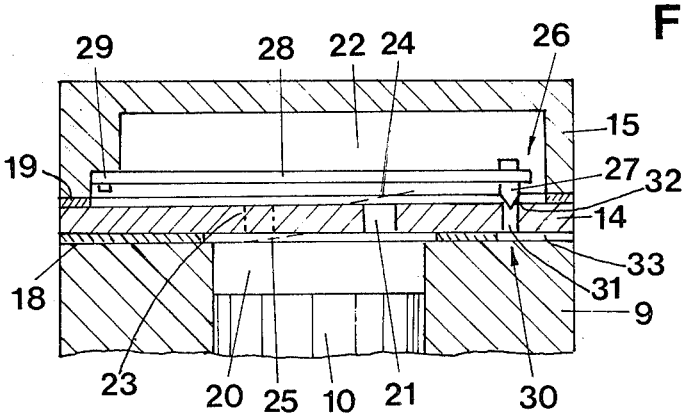

The invention will now be described in more detail with reference to a preferred example diagrammatically illustrated in the drawing, wherein:

FIG. 1 is a diagrammatic representation of a hermetically encapsulated small refrigerator in which the starting relief of the invention is utilised and FIG. 2 is a section through the upper portion of the cylinder, the valve plate and the cylinder cover.

In FIG. 1, a motor compressor 2 is suspended from springs 3 in a capsule 1. The supporting member 4 also comprises a bearing 6 in which a motor shaft 7 is mounted. The latter carries the rotor 8 of the motor. Further, a cylinder 9 made in one piece with the supporting member 4 contains a reciprocatable piston 10. The drive takes place by way of a connecting rod 11 of which the bearing 12 engages over a crank pin 13 on the motor shaft 7. The cylinder 9 is covered by a valve plate 14. Above this there is a cylinder cover 15. A resilient pressure tube 16 extending therefrom passes at a point (not shown) outwardly through the capsule 1. Another connection (not shown) serves to connect a suction conduit so that the interior 17 of the capsule 1 is at suction pressure.

FIG. 2 shows in more detail the component consisting of the cylinder 9, valve plate 14 and cylinder cover 15. A first sealing plate 18 is disposed between the cylinders 9 and the valve plate 14 and a second sealing plate 19 is disposed between the valve plate 14 and the cylinder cover 15. The cylinder chamber 20 is connected by way of a pressure valve bore 21 to a cylinder cover chamber 22 on the pressure side and by way of a suction valve bore indicated at 23 to a cylinder cover chamber which is not visible on the suction side. The associated closing members are formed by a pressure valve plate 24 and suction valve plate 25, respectively, indicated in their open position in broken lines.

The motor compressor as so far described operates in conventional manner. On the suction stroke, the suction valve plate 25 is raised whilst the pressure valve is closed. On the compression stroke, the pressure valve plate 24 is raised whilst the suction valve is closed.

In the cylinder cover chamber 22 on the pressure side there is a stop valve 26 of which the closing member 27 is at one end of a bimetallic strip 28 of which the other end 29 is secured to the cylinder cover 15. A throttling connecting passage 30 comprises a bore 31 in the valve plate 14 of which the inlet side 32 forms a stop valve seat, and a cut-out 33 in the sealing plate 18 that leads from the bore 31 to the periphery.

The stop valve 26 is such that it is open with cold gas in the cylinder cover chamber 22. The pressure side of the refrigerant system is therefore connected to the suction side by way of the connecting passage 30 and consequently relieved. For this reason, the motor starts at a low load. When pressurised gas is being delivered after running up to speed, the gas cannot flow off to the suction side completely because of the throttling effect of the connecting passage 30. A pressure is therefore built up on the pressure side. Compression leads to heating of the gas. As soon as a predetermined temperature has been reached, for example 80° to 100° C., the stop valve 26 will close. The pressure and suction sides are now separated from each other. The machine operates without volumetric losses. When the motor is switched off, the gas in the cylinder cover chamber 22 cools. The stop valve 26 therefore opens. In a refrigerator with a capillary tube, a first pressure compensation takes place by way of this capillary tube after the motor has been switched off. The remainder of the pressure compensation then takes place by way of the connecting passage 30.

Other constructions are readily possible. For example, the setting element of the stop valve 26 could also be a bellows box with a liquid or liquid/vapour filling which pushes the closing member 27 onto the seat 32 at the desired limiting temperature. The connecting passage could also pass through a different wall of the cylinder cover 15. The components could also be accommodated in a different chamber on the pressure side reached by the pressurised gas conveyed on starting.

I claim:

1. A motor-driven reciprocating piston compressor for hermetically encapsulated small refrigerators, comprising, a housing forming a cylinder chamber, a piston in said cylinder chamber, a valve plate and an interposed sealing plate at one end of said cylinder chamber, said valve plate having suction and pressure bores communicating with said cylinder chamber, said bores being closed by respective suction and pressure valves, a cylinder cover forming with said valve plate a cover chamber, a throttling connecting passage passing through said valve plate, said sealing plate having a cut-out aligned with said connecting passage to provide fluid communication between said cover chamber and the exterior of said cylinder cover and said housing, a valve element for said connecting passage, temperature responsive bimetal actuating means in said cover chamber connected to and controlling said valve element to close said connecting passage when the temperature of a gas in said cover chamber exceeds a predetermined value, said bimetal element being a strip extending parallel to said valve plate and being mounted in and to said cover chamber at one end thereof and carries said valve element at the other end thereof, said compressor being mounted in a capsule which is at suction pressure, and said actuating means being designed to close said connecting passage at about 80 to 100 degrees centigrade.

* * * * *